United States Patent [19]

Katayama et al.

[11] Patent Number: 4,719,079

[45] Date of Patent: Jan. 12, 1988

[54] CONTINUOUS-CAST LOW-CARBON RESULFURIZED FREE-CUTTING STEEL

[75] Inventors: Sakae Katayama; Tatsuya Imai, both of Sagamihara; Norio Onodera; Yasushi Ishibashi, both of Muroran, all of Japan

[73] Assignee: Nippon Steel Corporation, Tokyo, Japan

[21] Appl. No.: 888,977

[22] Filed: Jul. 23, 1986

[30] Foreign Application Priority Data

Jul. 24, 1985 [JP] Japan ..... 60-162047

[51] Int. Cl.[4] ..... C22C 38/60

[52] U.S. Cl. ..... 420/84; 420/87

[58] Field of Search ..... 420/84, 87

[56] References Cited

FOREIGN PATENT DOCUMENTS

| | | | |
|---|---|---|---|
| 48-21613 | 3/1973 | Japan | 420/87 |
| 59-19182 | 5/1984 | Japan . | |
| 59-205453 | 11/1984 | Japan . | |
| 61-110754 | 5/1986 | Japan | 420/84 |

OTHER PUBLICATIONS

Kimura et al, Tetsu-To-Hagane, vol. 71, 1985, No. 5, p. 242 (s 528) issued Mar. 4, 1985 (with translation).

Ohtani et al, ibid, vol. 69, 1983, No. 5, p. 199 (s 515), issued Mar. 1, 1983 (with translation: Transactions ISIJ [B349]).

Katayama et al, ibid, vol. 71, 1985, No. 5, pp. 244, 245, 246 (s 530, s 531, s 532) issued Mar. 4, 1985 (with translation: Transaction ISIJ [B227] [B228] [B229]).

*Primary Examiner*—L. Dewayne Rutledge
*Assistant Examiner*—Deborah Yee
*Attorney, Agent, or Firm*—Kenyon & Kenyon

[57] ABSTRACT

A continuous-cast low-carbon resulfurized free-cutting steel which consists in weight percentage of C: 0.05–0.15,
Mn: 0.5–1.5,
P: 0.05–0.10,
S: 0.15–0.40,
O: 0.010–0.020, one or more of Pb, Bi, and Te as accompanying elements for improving machinability at a following content:

Pb: 0.05–0.40,
Bi: 0.05–0.40, and
Te: 0.003–0.10,

Si: 0.003 or less,
Al; 0.0009 or less, and the remainder consisting of Fe and unavoidable impurities, and contains a manganese sulfide-base inclusion with the provision that:

a mean sectional area of the manganese sulfide-base inclusion present in a sectional area of 1 $mm^2$ in the rolling direction of the steel is not less than 30 $\mu m^2$; and a rate of the number of a manganese sulfide-base inclusions not in the form of a complex with oxide is not less than 80% of the total amount of manganese sulfide-base inclusion.

6 Claims, 4 Drawing Figures

CONTINUOUS-CAST LOW-CARBON RESULFURIZED FREE-CUTTING STEEL

BACKGROUND OF THE INVENTION

1. Field of the Invention

The present invention relates to a continuous-cast low-carbon resulfurized free-cutting steel, particularly to a continuous-cast low-carbon resulfurized free-cutting steel containing comparatively finely distributed manganese sulfide-base inclusions having a high plastic-deformability and thereby giving an excellent machined surface roughness.

2. Description of the Related Art

The increasing automatization and numerical-control of machining has doubled the demand for free-cutting steel over the last ten years. In this connection, serious efforts have been made to enhance the life of tools used in the cutting of free-cutting steel produced by continuous casting to the same level as that of tools used to cut free-cutting steel produced by ingot mold casting. For example, Japanese Examined Patent Publication (Kokoku) No. 59-19182 discloses that manganese sulfide in the form of a oval with a smaller length-to-width ratio effectively improves tool life. As a practical method of distributing manganese sulfide in the form of an oval in steel, this publication proposes limiting the %[S], %[C], and %[O ] in molten steel. Japanese Unexamined Patent Publication No. 59-205453 describes an effective method of improving tool life whereby manganese sulfide is spheroidized so as to have a length-to-width ratio of 5 or less and the content of $Al_2O_3$-base inclusion, which has a significant abrasive effect, is reduced. The publication proposes the addition of Te, Pb, and Bi for spheroidizing the manganese sulfide, and a content of Al in the steel of not more than 0.002%, to reduce the amount of $Al_2O_3$. Further, among papers to academic societies, Tetsu-To-Hagane (Journal of The Iron and Steel Institute of Japan), vol. 71, 1985, No. 5, P. 242, for example, reports that, as the width of manganese sulfide increases, the tool wear is reduced, which coincides with the disclosures of the above-mentioned patent publications.

Nevertheless, although the tool life has been improved as mentioned above, the machined surface roughness of the continuous-cast free-cutting steel is still inferior to that of the ingot-mold-cast free-cutting steel, and thus is evaluated as being of a lower level. Therefore, a further improvement is desired.

A current prevailing theory for the mechanism through which manganese sulfide extends the tool life, and consequently improves the machined surface roughness, asserts that manganese sulfide reduces the shear stress on the shear plane. That is, the temperature at the tool edge is lowered in accordance with the extent of the reduction of the shear stress, which results in the reduction of tool wear. It is alleged that, in order to reduce shear stress, manganese sulfide is preferably in the form of oval with a small length-to-width ratio which causes a significant notch effect. All current methods for improving the tool life for continuous-cast free-cutting steel are based on this mechanism. The methods according to this mechanism, however, are not sufficient to meet the industrial machined surface roughness requirements, and the development of novel mechanisms and methods based thereupon are obviously necessary.

As described in Tetsu-To-Hagane, vol. 69, 1983, No. 5, p. 199, since the continuous-cast free-cutting steel in comparison with the ingot mold-cast free-cutting steel produces less fluctuation in the tool life and has a superior homogeniety, a free-cutting steel comparable or superior to the ingot mold-cast free-cutting steel can be expected if the machined surface roughness is improved. Therefore, the development of such a continuous-cast free-cutting steel is greatly desired in industry.

Further, the evaluations of the machined surface roughness do not correspond to each other regarding the practical use of and the results obtained by the established test methods, such as the JIS-method, etc., which have significantly obstructed the development of the continuous-cast free-cutting steel. The present inventors and others, as reported in Tetsu-To-Hagane, vol. 71, 1985, No. 5, s530 (English translation published in Transactions of ISIJ, vol. 25, 1985, No. 9, B227), have already thrown light on the cause of the incompatibility between the evaluations and have developed a testing method which can simulate a cutting condition having a practical use. That is, this method adopts a repetition of a short time cutting and a pause, for example, 2 to 4 sec, according to the most usual machining condition such as in plunge cutting by an automatic screw machine of the free-cutting steel, which is distinct from the methods heretofore used, such as the JIS-method, etc., where a long time cutting duration of, for example, 450 sec, is adopted. Such a difference between the duration of the times of cutting in these testing methods causes a discrepancy in the temperature reached by the tool edge (cutting part) during cutting, and therefore gives rise to the inconsistency which has been found between the performance in practical use and the results obtained by the conventionally established testing methods, such as the JIS-method, etc.

The present inventors and others, as reported in Tetsu-To-Hagane, vol. 71, 1985, No. 5, s531 and s532 (English translation is published in ibid B228 and B229), tested various commercial steels for which the machined surface roughnesses were variously evaluated in practical use, by using the above-mentioned developed testing method and metallurgical observation. The test results showed that, first, in the steel exhibiting an excellent machined surface, a layer of manganese sulfide-base inclusion is formed on the tool edge during cutting, which suppresses the adhesion of work to the tool edge and the generation of built-up edge on the tool edge (Tetsu-To-Hagane, vol. 71, 1985, No. 5, s531). On the contrary, in the steel exhibiting an inferior machined surface, adhesion between the work and the tool and a built-up edge growth are prevalent. The built-up edge once formed on the tool edge falls away onto the machined surface, and thus significantly roughens the machined surface. This suggests that the manganese sulfide-base inclusion layer has an essential function of lubrication between the tool edge and the work. Second, the formation of the layer is promoted as the size (mean sectional area) of the manganese sulfide-base inclusion increases (Tetsu-To-Hagane, vol. 71, 1985, No. 5, s532). This suggests that the increase in the size of the manganese sulfide-base inclusion promotes a separation of the manganese sulfide-base inclusion from the steel, and further, increases the amount of layer formed on the tool edge, which further improves the machined surface roughness.

However, in the continuous-cast free-cutting steel, a condition sufficient to stably form the above-mentioned effective layer of manganese sulfide-base inclusion on the tool edge has yet to be discovered.

SUMMARY OF THE INVENTION

Accordingly, an object of the present invention is to provide a continuous-cast low-carbon resulfurized free-cutting steel fully satisfying the condition for stably forming an effective layer of manganese sulfide-base inclusion on the tool edge and thereby producing an excellent machined surface roughness which will be industrially profitable.

The object is achieved by a continuous-cast low-carbon resulfurized free-cutting steel which consists in weight percentage of C: 0.05–0.15,
Mn: 0.5–1.5,
P: 0.05–0.10,
S: 0.15–0.40,
O: 0.010–0.020,
one or more of Pb, Bi, and Te as accompanying elements for improving machinability at a following content:
Pb: 0.05–0.40,
Bi: 0.05–0.40, and
Te: 0.003–0.10,
Si: 0.003 or less,
Al: 0.0009 or less, and
the remainder consisting of Fe and unavoidable impurities, and contains a manganese sulfide-base inclusion with the provision that:
a mean sectional area of the manganese sulfide-base inclusion present in a sectional area of 1 $mm^2$ in the rolling direction of the steel is not than 30 $\mu m^2$; and
a rate of the number of manganese sulfide-base inclusions not in the form of a complex with oxide is not less than 80% of the total amount of manganese sulfide-base inclusion.

The manganese sulfide-base inclusion is not particularly specified provided it contains manganese sulfide as a main component. The manganese sulfide-base inclusion preferably comprises manganese sulfide alone and manganese sulfide in the form of a complex with one or more of Pb, Bi, and manganese telluride.

Any one of Pb, Bi, and Te may be contained in the steel as an accompanying element for improving machinability at a content in the above-specified respective content range.

Preferably, the mean sectional area of the manganese sulfide-base inclusion present in a sectional area of 1 $mm^2$ in the rolling direction of the steel is 100 $\mu m^2$ or more.

DESCRIPTION OF THE PREFERRED EMBODIMENT

The present inventors studied the various factors expected to essentially influence the formation of the formerly reported manganese sulfide-base inclusion layer on the tool edge (Tetsu-To-Hagane, vol. 71, 1985, No. 5, s531 and s532) by using the formerly developed testing method (Tetsu-To-Hagane, vol. 71, 1985, No. 5, s530), and found that, when manganese sulfide-base inclusion is formed as a complex inclusion with oxide, the machined surface roughness increases. This is considered to be because, in the manganese sulfide-base inclusion in the form of a complex with oxide, the oxide itself does not deform, with the result that the plastic-deformability of the manganese sulfide-base inclusion is reduced. In order to fully satisfy the condition for forming the manganese sulfide-base inclusion layer on the tool edge, the manganese sulfide-base inclusion must be plastically deformed and spread in the form of film at a temperature prevailing at and under a stress on the tool edge during cutting. Therefore, it is necessary to distribute in steel as much as possible of the manganese sulfide-base inclusion not in the form of a complex with oxide, i.e., discrete from oxide.

Figure 1:
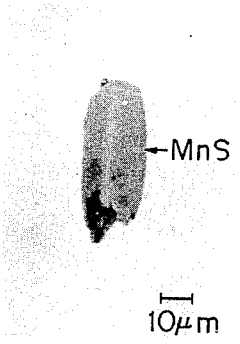
FIGS. 1(1) to 1(3) are metallurgical microphotographs showing the various morphologies of manganese sulfide-base inclusions present in steel.
Figure 1:
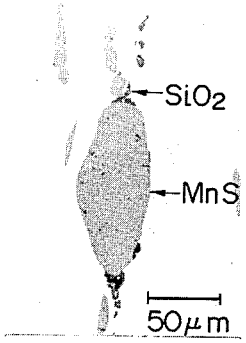
Figure 1:
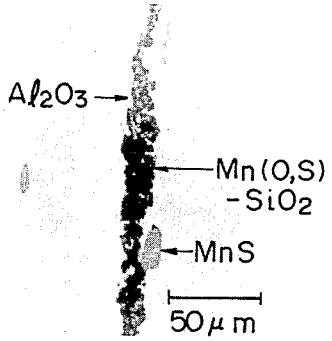

Referring to FIGS. 1(1) to 1 (3), the morphological or structural variation of the manganese sulfide-base inclusion will be described. FIG. 1(1) shows an example of a manganese sulfide-base inclusion consisting essentially of manganese sulfide alone (denoted as MnS); FIG. 1(2) shows an example of a manganese sulfide-base inclusion in the form of a complex, the largest inclusion in this figure, composed of manganese sulfide and oxide mainly consisting of silicon oxide (denoted as $SiO_2$), where the oxide particles are present at the tail portions of the manganese sulfide body; and FIG. 1(3) shows an example of a manganese sulfide-base inclusion in the form of a complex composed of manganese sulfide, oxide mainly consisting of aluminum oxide (denoted as $Al_2O_3$, and another compound mainly consisting of manganese sulfide oxide (denoted as Mn (OS)) and silicon oxide (denoted as $Si_2$), where the component compounds are present in a mixed state.

Figure 2:
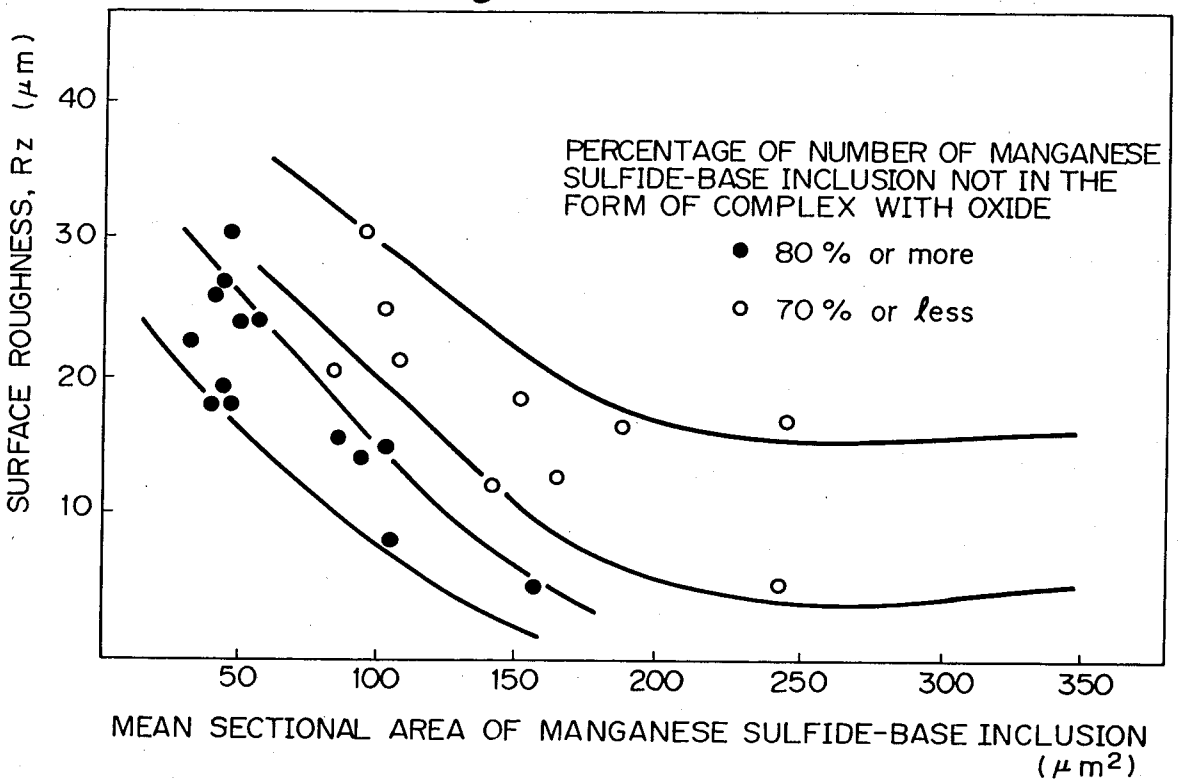
FIG. 2 is a diagram showing the relationship of the machined surface roughness to the mean sectional area of the manganese sulfide-base inclusion and the percentage of the number of manganese sulfide-base inclusions not in the form of a complex with oxide.

FIG. 2 shows the effect of the rate of the number of manganese sulfide-base inclusions not in the form of a complex with oxide, i.e., discrete from oxide, and the effect of the mean sectional area of the manganese sulfide-base inclusion on the machined surface roughness in terms of Rz value according to JIS B0601. In FIG. 2, the solid circles correspond to the samples having a rate of the number in percentage of 80% or more, and the blank circles correspond to the samples having a rate of the number in percentage of 70% or less. It is seen that, in the group of samples with the higher rate of the number, an identical surface roughness (Rz value) is achieved at a smaller mean sectional area in comparison with the group of samples with the lower rate of the number. That is, the increase in the rate of the number of manganese sulfide-base inclusions not in the form of a complex with oxide is extremely effective for improving the machined surface roughness of the free-cutting steel having a relatively fine manganese sulfide-base inclusion distribution.

The constitution and preferred embodiments of the present invention to satisfy the above-mentioned conditions will now be described.

First, the chemical contents of a steel according to the present invention must be within the following ranges in weight percentage, respectively:

The C content must be not less than 0.05% to ensure the desired machined surface roughness, but the C content must not exceed 0.15% because the fraction shared by the hard pearlite phase is increased and the machinability of the steel is lowered when this critical value is exceeded.

The Mn content must be not less than 0.5%, to form the necessary amount of manganese sulfide-base inclusion and prevent FeS from precipitating at the grain boundary of the steel, so as to avoid cracking during hot rolling. However, the Mn content must not exceed 1.5%, because the hardness of the steel becomes higher, resulting in a loss in the machinability of the steel when this value is exceeded.

The P content must be not less than 0.05%, to improve the machined surface roughness. To ensure the mechanical property and cold-workability of steel, the P content must not exceed 0.10%.

The S content must be not less than 0.15%, to form a manganese sulfide-base inclusion in the steel which restrains the growth of the built-up edge and thus improves the machined surface roughness. To ensure the cold-workability of steel, however, the S content must not exceed 0.40%.

The O content must be not less than 0.010%, to prevent the manganese sulfide-base inclusion from elongation in the form of a string during rolling, which lowers the machinability of the steel. However, to ensure the plastic deformability of manganese sulfide-base inclusion during cutting, the O content must not exceed 0.020%.

Pb, Bi, and Te reduces the curling radius of chip, so that the chip disposability is improved. Moreover, these elements have an effect in that they increase the area of the manganese sulfide-base inclusion layer and thereby improve the machined surface roughness. These elements have a difference in the morphology when present in steel. Namely, Pb and Bi are present in steel as metallic inclusions, Pb and Bi, and Te is present as a non-metallic inclusion, manganese telluride. Also, when they are in the form of a complex with manganese sulfide-base inclusion, Pb and Bi are present as Pb and Bi, and Te is present as manganese telluride. Consequently, their contents are set to be different, i.e, the lower limits of the Pb, Bi, and Te contents are 0.05%, 0.05%, and 0.003% and the upper limits are 0.4%, 0.4%, and 0.1%, respectively. When any of the upper limits is exceeded, the hot-workability is significantly lowered.

Si forms $SiO_2$ which is apt to form a complex with the manganese sulfide-base inclusion. The plastic-deformability of such a complex inclusion is so poor that it restrains the formation of manganese sulfide-base inclusion layer on the tool edge, with the result that the built-up edge grows and impairs the machined surface. Therefore, the content of Si must be controlled to be as low as possible. Consequently, the content of Si must be limited to not higher than 0.003%.

Al forms $Al_2O_3$ which is also apt to form a complex with the manganese sulfide-base inclusion. The plastic-deformability of such a complex inclusion is again so small that it restrains the formation of the manganese sulfide-base inclusion layer on the tool edge, with the result that the built-up edge grows and impairs the machined surface. Therefore, the content of Al must be limited to not higher than 0.0009%. When the Al content is more than 0.0009%, the ratio of the area of the tool edge surface covered by the manganese sulfide-base inclusion layer is abruptly reduced and heavily impairs the machined surface roughness.

Next, the manganese sulfide-base inclusion in steel must have a mean sectional area of not less than 30 $\mu m^2$, in order that it is separated from steel to be transferred to the tool rake face. When the mean sectional area is 100 $\mu m^2$ or more upon the transfer of the manganese sulfide-base inclusion separated from the steel, the ratio of the area of the tool rake face covered by the layer is larger and gives a further lubrication effect to a corresponding extent. The optimum mean sectional area is 100 $\mu m^2$ or more.

The manganese sulfide-base inclusion cannot grow as large in the continuous casting as in the ingot mold casting. At present, a maximum mean sectional area of about 150 $\mu m^2$ is achieved through continuous casting. Because of this, the size of the manganese sulfide-base inclusion is preferably made as large as possible, and an upper limit thereto need not be set.

When the manganese sulfide-base inclusion is in the form of a complex with one or more of $Al_2O_3$, $SiO_2$, MnO, and other oxides, i.e., the manganese sulfide-base inclusion is not discrete from the oxides, such a complex inclusion has a low plastic-deformability that will not allow plastic deformation of the manganese sulfide-base inclusion at a temperature prevailing at and under a stress on the tool edge during cutting. Thus, such oxides are not only ineffective for the formation of manganese sulfide-base inclusion layer on the tool edge, but they also act to exfoliate the manganese sulfide-base inclusion layer once formed from the tool edge surface by an abrasion effect due to their high hardness. Consequently, the amount of manganese sulfide-base inclusion layer formed is abruptly decreased when the rate of the number of manganese sulfide-base inclusions in the form of a complex with oxide exceeds 20%. Therefore, the rate of the number of manganese sulfide-base inclusions not in the form of complex with oxide must be not less than 80%.

Only the manganese sulfide-base inclusion having a sectional area of more than 10 $\mu m^2$ is counted, irrespective of whether or not it is in the form of a complex with oxide, because it is difficult to determine the area of an inclusion as fine an area of less than 0 $\mu m^2$.

To reduce the amount of oxide, the manufacturing process is preferably controlled as follows:

A desiliconization treatment is performed in the pretreatment of molten pig iron; only the desiliconized pig iron is fed as the raw material to the converter in order to prevent the contamination by Al and Si from scrap; deoxidation, if necessary, is performed by carbon without the use of Al or Si; and, upon casting, $ZrO_2$ refractories are used at the vicinity of the site where the solidification begins, and the use of $Al_2O_3$ or $SiO_2$ refractories is minimized.

To obtain a manganese sulfide-base inclusion having a sectional area of 30 $\mu m^2$ or more, the cooling water rate upon continuous casting is reduced as far as possible so that an optimum slow cooling is achieved. That is, the cooling water rate for the strand is controlled so that the solidification rate at the middle point between the surface and core of the strand is 3.4 mm/min or less.

After the solidification is completed, heating, rolling, and other necessary steps are performed to obtain a steel product in the desired form.

Next, the effect of the present invention will be described in detail by the following example.

EXAMPLE

The steels shown in Table 1 were tested by lathe turning in the direction perpendicular to the rotating axis, using a high speed steel tool. In Table 1, steels No. 1 to 9 are the steels according to the present invention, and steels No. 10 to 17 are comparative steels.

In the steels according to the present invention, an LD process with a desiliconized pig iron rate of 100% was performed, the refractory bricks were carefully checked, and Ar-bubbling was performed for the removal of $Al_2O_3$. Accordingly, the content of Al and Si was reduced, with the result that the rate of the number of manganese sulfide-base inclusions not in the form of a complex with oxide was 80% or more of the total amount of manganese sulfide-base inclusion. Continuous casting was performed under the condition that the size of a strand was 350 mm×560 mm and the cooling water rate was controlled to 0.45 l/kg-steel, resulting in a solidification rate of 3.2 mm/min at the middle point between the surface and core of the strand. The thus continuous-cast steel was heated at 1200° C. for 90 min and then hot-rolled. Finish-rolling was performed at a temperature of 1000° C. to obtain a round bar steel product 80 mm in diameter, from which the samples to be tested were prepared.

The conditions of the lathe turning test were as follows:

Tool material: JIS SKH57,
Cutting speed: 80 and 120 m/min,
Feed: 0.05 mm/rev,
Cutting cycle: cutting 2 sec-pause 5 sec,
Total number of cutting cycles: 800, and
Machined surface roughness: Rz (JIS B0601).

The mean sectional area of the manganese sulfide-base inclusion was determined by measuring the manganese sulfide-base inclusions present in the sectional area of 1 $mm^2$ in the rolling direction of the steel by means of an optical microscope with a magnification of 200. Upon measuring, fine manganese sulfide-base inclusions of less than 10 $\mu m^2$ were excluded. The rate of the number of manganese sulfide-base inclusions was determined by observing the manganese sulfide-base inclusions present in the sectional area of 1 $mm^2$ by using an optical microscope with a magnification of 200. As seen from Table 1, the steels according to the present invention had a superior machined surface roughness in comparison with the comparative steels, since the machined surface roughness of the steel according to the present invention is about 30% that of the comparative steel.

Throughout the treatment of the molten pig iron, steel making, and continuous casting, the manufacturing steps were controlled as mentioned before, so that the necessary rate of the number of manganese sulfide-base inclusions not in the form of a complex with oxide was obtained, with the result that free-cutting steels having an excellent machined surface roughness were obtained. Even when manganese sulfide-base inclusion is large enough, the machined surface roughness was not satisfactory if the other conditions were not satisfied (comparative steels No. 10 to 12).

In the comparative steels No. 13 to 17, i.e., in the usual continuous casting condition (solidification rate: 4.1 mm/min, strand size: 250 mm×560 mm, cooling water rate: 0.45 l/kg-steel) , the sectional area of the manganese sulfide-base inclusion was small and the machined surface roughness was inferior.

As shown above, the present invention provides a continuous-cast low-carbon resulfurized free-cutting steel having a superior machined surface roughness, and therefore, contributes greatly to the advancement of the industry.

TABLE 1

| | (Chemical composition: wt %) | | | | | | | | | | | | | | |
|---|---|---|---|---|---|---|---|---|---|---|---|---|---|---|---|
| Sample | C | Mn | P | S | Pb | O | Si | Al | Bi | Te | Mean sectional area of manganese sulfide-base inclusion $\mu m^2$ | Rate of number of manganese sulfide-base inclusion not in the form of a complex with oxide % | Machined surface roughness RZ, μm V = 80 m/min | Machined surface roughness RZ, μm V = 120 m/min | Casting process |
| Present invention | | | | | | | | | | | | | | | |
| 1 | 0.09 | 1.03 | 0.068 | 0.332 | 0.25 | 0.014 | 0.001 | 0.0005 | — | — | 130 | 86 | 6 | 8 | Continuous casting |
| 2 | 0.08 | 1.07 | 0.063 | 0.322 | 0.27 | 0.017 | 0.001 | 0.0007 | — | — | 40 | 89 | 7 | 9 | |
| 3 | 0.11 | 1.15 | 0.067 | 0.325 | 0.22 | 0.013 | 0.001 | 0.0007 | — | — | 80 | 92 | 7 | 9 | |
| 4 | 0.12 | 1.12 | 0.065 | 0.320 | 0.21 | 0.019 | 0.001 | 0.0005 | — | — | 100 | 83 | 5 | 7 | |
| 5 | 0.11 | 1.15 | 0.061 | 0.312 | — | 0.012 | 0.002 | 0.0007 | — | 0.06 | 130 | 84 | 7 | 8 | |
| 6 | 0.09 | 1.02 | 0.069 | 0.330 | — | 0.013 | 0.001 | 0.0005 | 0.28 | — | 90 | 85 | 6 | 8 | |
| 7 | 0.09 | 1.08 | 0.066 | 0.331 | 0.07 | 0.015 | 0.001 | 0.0007 | 0.20 | — | 110 | 87 | 10 | 8 | |
| 8 | 0.08 | 1.06 | 0.065 | 0.327 | 0.21 | 0.016 | 0.001 | 0.0007 | — | 0.03 | 120 | 85 | 7 | 9 | |
| 9 | 0.10 | 1.12 | 0.067 | 0.321 | 0.13 | 0.019 | 0.002 | 0.0007 | 0.12 | 0.03 | 110 | 86 | 8 | 9 | |
| Comparative sample | | | | | | | | | | | | | | | |
| 10 | 0.08 | 1.07 | 0.072 | 0.318 | 0.18 | 0.018 | 0.003 | 0.003 | — | — | 190 | 70 | 26 | 29 | Ingot mold casting |
| 11 | 0.09 | 1.05 | 0.069 | 0.322 | 0.25 | 0.017 | 0.004 | 0.004 | — | — | 220 | 65 | 31 | 35 | |
| 12 | 0.10 | 1.03 | 0.067 | 0.318 | 0.26 | 0.020 | 0.005 | 0.0009 | — | — | 280 | 67 | 35 | 35 | |
| 13 | 0.09 | 1.12 | 0.071 | 0.332 | 0.27 | 0.017 | 0.002 | 0.0007 | — | — | 20 | 73 | 29 | 34 | Continuous casting |
| 14 | 0.08 | 1.11 | 0.070 | 0.330 | 0.25 | 0.015 | 0.002 | 0.002 | — | — | 18 | 72 | 24 | 32 | |
| 15 | 0.08 | 1.03 | 0.072 | 0.312 | — | 0.020 | 0.005 | 0.003 | 0.22 | — | 20 | 69 | 26 | 30 | |
| 16 | 0.09 | 1.02 | 0.070 | 0.325 | 0.12 | 0.017 | 0.005 | 0.005 | — | 0.02 | 18 | 67 | 28 | 28 | |
| 17 | 0.08 | 1.05 | 0.071 | 0.325 | 0.05 | 0.022 | 0.003 | 0.009 | 0.10 | 0.02 | 22 | 62 | 22 | 25 | |

We claim:

1. A continuous-cast low-carbon resulfurized free-cutting steel which consists, in weight percentage, of
C: 0.05–0.15,
Mn: 0.5–1.5,
P: 0.05–0.10,
S: 0.15–0.40,
O: 0.010–0.020,
one or more of Pb, Bi, and Te as accompanying elements for improving a machinability at a following content:
Pb: 0.05–0.40,
Bi: 0.05–0.40, and
Te: 0.003–0.10, Si: 0.003 or less, Al: 0.0009 or less, and the remainder consisting of Fe and unavoidable impurities, and contains a manganese sulfide-base inclusion with the provision that:

a mean sectional area of the manganese sulfide-base inclusion present in a sectional area of 1 $mm^2$ in the rolling direction of the steel is not less than 30 $\mu m^2$; and a rate of the number of manganese sulfide-base inclusions not in the form of a complex with oxide is not less than 80% of the total amount of manganese sulfide-base inclusion.

2. A continuous-cast low-carbon resulfurized free-cutting steel according to claim 1, wherein said manganese sulfide-base inclusion is a complex inclusion of manganese sulfide and one or more of Pb, Bi, and manganese telluride.

3. A continuous-cast low-carbon resulfurized free-cutting steel according to claim 1, which contains Pb alone at a content in weight percentage of from 0.05 to 0.40 as said accompanying element for improving the free-cutting property.

4. A continuous-cast low-carbon resulfurized free-cutting steel according to claim 1, which contains Bi alone at a content in weight percentage of from 0.05 to 0.40 as said accompanying element for improving the free-cutting property.

5. A continuous-cast low-carbon resulfurized free-cutting steel according to claim 1, which contains Te alone at a content in weight percentage of from 0.003 to 0.10 as said accompanying element for improving the free-cutting property.

6. A continuous-cast low-carbon resulfurized free-cutting steel according to any one of claims 1 to 5, wherein said mean sectional area is 100 $\mu m^2$ or more.

* * * * *